US010804607B2

(12) United States Patent
Hsieh et al.

(10) Patent No.: US 10,804,607 B2
(45) Date of Patent: Oct. 13, 2020

(54) MULTIBAND ANTENNA STRUCTURE AND WIRELESS COMMUNICATION DEVICE USING SAME

(71) Applicant: Chiun Mai Communication Systems, Inc., New Taipei (TW)

(72) Inventors: Wei-En Hsieh, New Taipei (TW); Chien-Hua Li, New Taipei (TW); Yih-Shyang Her, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 79 days.

(21) Appl. No.: 16/109,699

(22) Filed: Aug. 22, 2018

(65) Prior Publication Data

US 2019/0097319 A1 Mar. 28, 2019

(30) Foreign Application Priority Data

Sep. 27, 2017 (CN) ..... 2017 1 0891620

(51) Int. Cl.
*H01Q 5/30* (2015.01)
*H01Q 1/24* (2006.01)
(Continued)

(52) U.S. Cl.
CPC ..... *H01Q 5/30* (2015.01); *H01Q 1/243* (2013.01); *H01Q 1/48* (2013.01); *H01Q 5/328* (2015.01);
(Continued)

(58) Field of Classification Search
CPC ..... H01Q 5/30; H01Q 21/30; H01Q 5/328; H01Q 1/48; H01Q 9/42; H01Q 7/00;
(Continued)

(56) References Cited

U.S. PATENT DOCUMENTS 9,379,429 B2 6/2016 Liu et al.
9,660,329 B2 5/2017 Lin et al.
(Continued)

FOREIGN PATENT DOCUMENTS

CN 103779652 A 5/2014
CN 104425880 A 3/2015
(Continued)

*Primary Examiner* — Hai V Tran
*Assistant Examiner* — Michael M Bouzza
(74) *Attorney, Agent, or Firm* — ScienBiziP, P.C.

(57) ABSTRACT

An antenna structure includes a housing, a radiator, a first feed portion, and a first ground portion. The housing includes a coupling portion and a coupling section. The first feed portion, the first ground portion, and the radiator are all positioned in the housing. When a first feed point supplies current, the current flows through the first feed portion and the radiator, and is coupled to one of the coupling portion and the coupling section through the radiator. The current is further coupled to the other one of the coupling portion and the coupling section through the one of the coupling portion and the coupling section. The radiator, the coupling portion, and the coupling section activate three different operating modes. Each mode operating generates radiation signals in one of three different radiation frequency bands.

27 Claims, 11 Drawing Sheets

(51) Int. Cl.

| | |
|---|---|
| ***H01Q 7/00*** | (2006.01) |
| ***H01Q 9/42*** | (2006.01) |
| ***H01Q 1/48*** | (2006.01) |
| ***H01Q 5/328*** | (2015.01) |
| ***H01Q 21/30*** | (2006.01) |
| *H01Q 5/378* | (2015.01) |
| *H01Q 5/364* | (2015.01) |

(52) U.S. Cl.
CPC ..... *H01Q 7/00* (2013.01); *H01Q 9/42* (2013.01); *H01Q 21/30* (2013.01); *H01Q 5/364* (2015.01); *H01Q 5/378* (2015.01)

(58) Field of Classification Search
CPC ..... H01Q 1/243; H01Q 5/364; H01Q 5/378; H01Q 9/04; H01Q 1/24
See application file for complete search history.

(56) References Cited

U.S. PATENT DOCUMENTS

2015/0155616 A1* 6/2015 Lin ..... H01Q 1/243
343/702
2016/0336644 A1 11/2016 Lee et al.

FOREIGN PATENT DOCUMENTS

| | | | |
|---|---|---|---|
| CN | 205039250 | U | 2/2016 |
| CN | 105470647 | A | 4/2016 |
| TW | 201448347 | A | 12/2014 |
| TW | 201644095 | | 12/2016 |

* cited by examiner

MULTIBAND ANTENNA STRUCTURE AND WIRELESS COMMUNICATION DEVICE USING SAME

FIELD

The subject matter herein generally relates to an antenna structure and a wireless communication device using the antenna structure.

BACKGROUND

Metal housings, for example, metallic backboards, are widely used for wireless communication devices, such as mobile phones and personal digital assistants (PDAs). Antennas are also important components in wireless communication devices for receiving and transmitting wireless signals at different frequencies, such as signals in Long Term Evolution Advanced (LTE-A) frequency bands. However, when the antenna is located in the metal housing, the antenna signals are often shielded by the metal housing. This can degrade the operation of the wireless communication device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
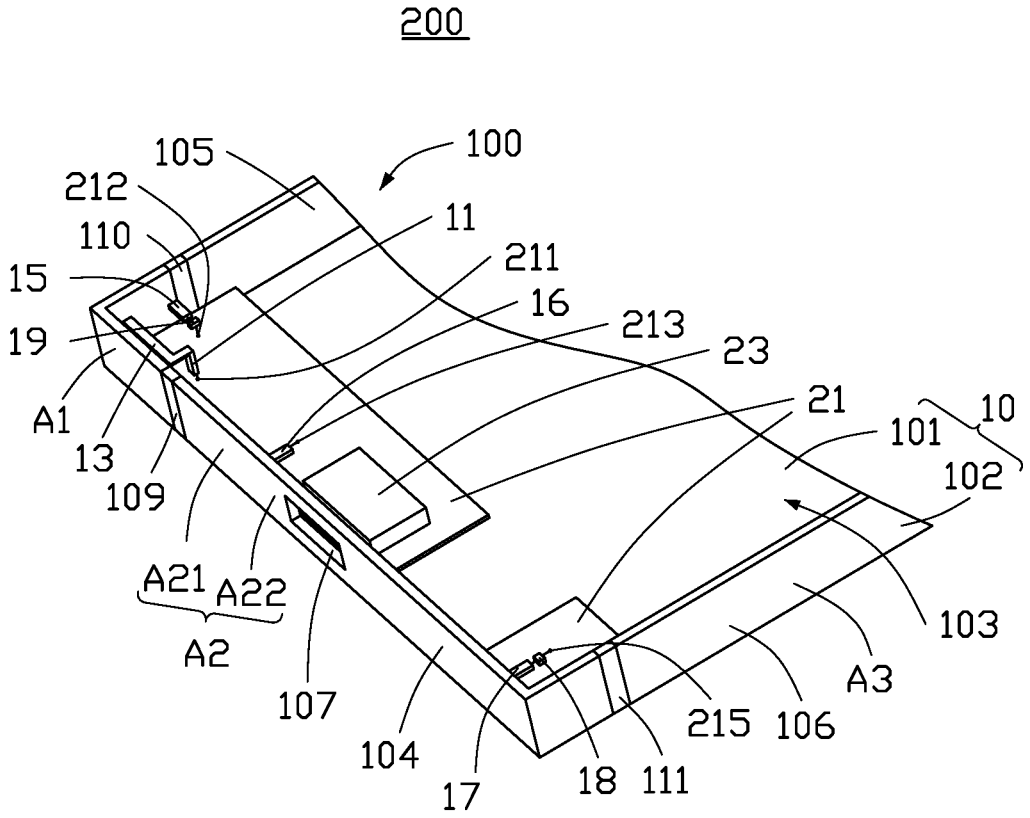
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200 using an antenna structure 100. The wireless communication device 200 can be, for example, a mobile phone or a personal digital assistant. The antenna structure 100 can receive and transmit wireless signals.

In this embodiment, the wireless communication device 200 further includes a substrate 21 and an electronic element. The substrate 21 is a printed circuit board (PCB) and is made of dielectric material, for example, epoxy resin glass fiber (FR4) or the like. The substrate 21 includes a first feed point 211, a first ground point 212, a second feed point 213, and a second ground point 215.

The first feed point 211 and the second feed point 213 are configured to supply current to the antenna structure 100. The first ground point 212 and the second ground point 215 are configured for grounding the antenna structure 100.

The electronic element 23 can be, for example, a Universal Serial Bus (USB) module. The electronic element 23 is positioned on the substrate 21 between the first feed point 211 and the second ground point 215.

The antenna structure 100 includes a housing 10, a first feed portion 13, a radiator 13, a first ground portion 15, a second feed portion 16, and a second ground portion 17.

The housing 10 houses the wireless communication device 200 and can be made of metallic material. The housing 10 includes a backboard 101 and a side frame 102. The backboard 101 and the side frame 102 can be integrally formed with each other. The side frame 102 is positioned to surround a periphery of the backboard 101. The side frame 102 and backboard 101 form a receiving space 103. The receiving space 103 can receive the substrate 21, a processing unit, or other electronic components or other modules (not shown).

In this embodiment, the side frame 102 includes an end portion 104, a first side portion 105, and a second side portion 106. The first side portion 105 and the second side portion 106 are parallel to, and spaced apart from, each other. The end portion 104 has first and second ends. The first side portion 105 is connected to the first end of the first frame 111 and the second side portion 106 is connected to the second end of the end portion 104. In this embodiment, the end portion 104 can be a top portion or a bottom portion of the wireless communication device 200.

The housing 10 further defines a through hole 107, a slot 108 (shown in FIG. 2), a first gap 109, a second gap 110, and a third gap 111. In this embodiment, the through hole 107 is defined in, and passes through, the end portion 104. The through hole 107 corresponds to the electronic element 23.

Thus, the electronic element 23 can be partially exposed through the through hole 107. For example, a USB plug device can be inserted into the through hole 107 to be electrically connected to the electronic element 23.

Figure 2:
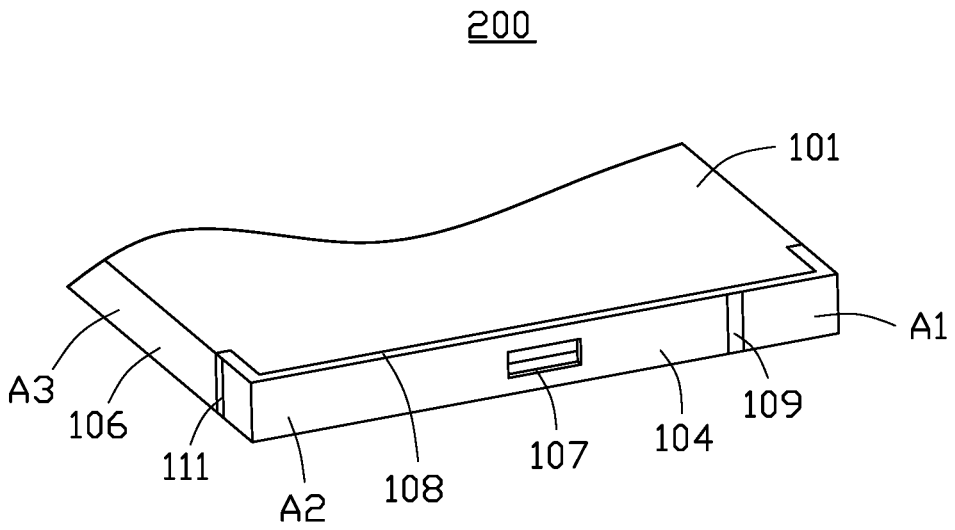
FIG. 2 is an assembled, isometric view of the wireless communication device of FIG. 1.
Figure 3:
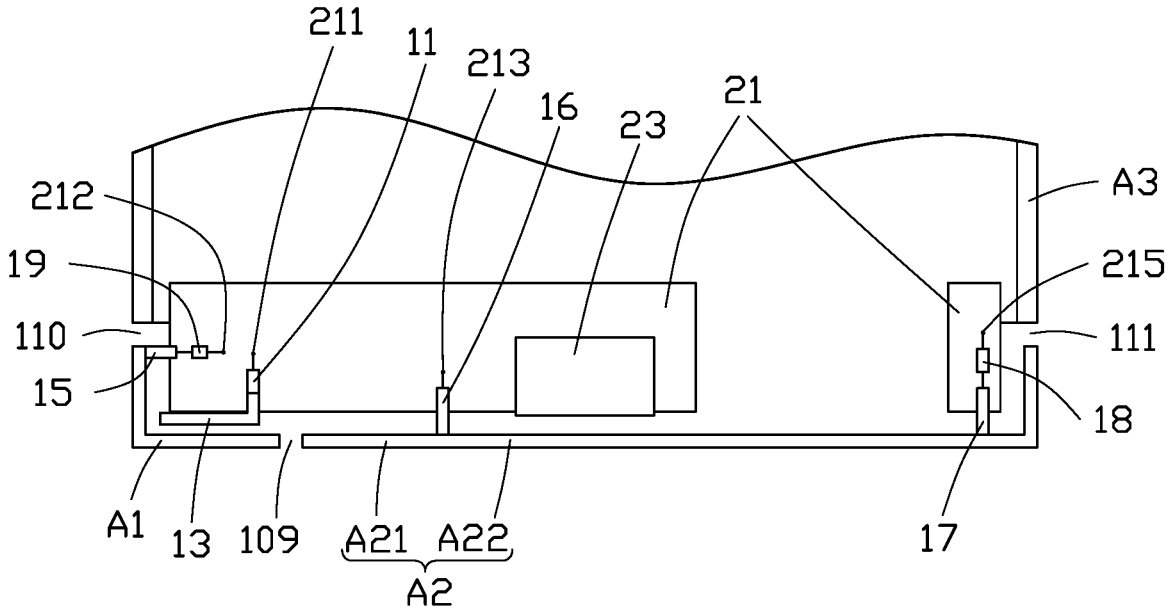
FIG. 3 is a circuit diagram of the antenna structure of FIG. 1.

In FIG. 2 and FIG. 3, the slot 108 is shown as substantially U-shaped. The slot 108 is defined on the backboard 101 adjacent to the end portion 104. The first gap 109, the second gap 110, and the third gap 111 are all defined by the side frame 102. The first gap 109 is defined by the end portion 104 adjacent to the first side portion 105. The second gap 110 is defined by the first side portion 105 adjacent to the end portion 104. The third gap 111 is defined by the second side portion 106 adjacent to the end portion 104.

The first gap 109, the second gap 110, and the third gap 111 are all in communication with the slot 108 and extend to cut across the side frame 102. The housing 10 is divided into three portions by the first gap 109, the second gap 110, and the third gap 111. The three portions are a coupling portion A1, a radiating portion A2, and a grounding portion A3.

The coupling portion A1 is formed by a first portion of the side frame 102 between the first gap 109 and the second gap 110. The radiating portion A2 is formed by a second portion of the side frame 102 between the first gap 109 and the third gap 111. The grounding portion A3 is formed by portions of the side frame 102 not associated with the coupling portion A1 and the radiating portion A2. The grounding portion A3 is grounded.

In this embodiment, the slot 108, the first gap 109, the second gap 110, and the third gap 111 are all filled with insulating material, for example, plastic, rubber, glass, wood, ceramic, or the like. The through hole 107 is not filled because it has to allow a plug device to pass through.

In other embodiments, the slot 108 may be other than U-shaped. For example, the slot 108 can be a straight strip, an oblique line, or a meander.

In this embodiment, the slot 108 is defined on the backboard 101 adjacent to the end portion 104 and extends to an edge of the end portion 104. The coupling portion A1 and the radiating portion A2 are completely formed by the end portion 104, a portion of the first side portion 105, and a portion of the second side portion 106. That is, the coupling portion A1 and the radiating portion A2 are formed by a portion of the side frame 102.

In other embodiments, a position of the slot 108 can be changed. For example, the slot 108 can be defined on a middle portion of the backboard 101. The coupling portion A1 and the radiating portion A2 are formed by a portion of the side frame 102 and a portion of the backboard 101.

In other embodiments, a location of the slot 108 is not limited to be the backboard 101 and the slot 108 can be defined on the end portion 104.

In this embodiment, the first feed portion 11 and the radiator 13 are both positioned in the receiving space 103. The first feed portion 11 and the radiator 13 are positioned in a receiving space (not labeled) beginning at the coupling portion A1 and ending at the first gap 109 and the second gap 110.

The first feed portion 11 can be a screw, a microstrip line, a probe, or other connecting structures. One end of the first feed portion 11 is electrically connected to the radiator 13. Another end of the first feed portion 11 is electrically connected to the first feed point 211 to supply current to the radiator 13.

The radiator 13 can be substantially L-shaped. The radiator 13 is positioned in a plane substantially parallel to backboard 101. One end of the radiator 13 is perpendicularly connected to an end of the first feed portion 11 spaced from the first feed point 211. Another end of the radiator 13 extends along a direction parallel to the first side portion 105 and towards the end portion 104, then bends perpendicularly, and then extends along a direction parallel to the end portion 104 and towards the first side portion 105. This forms the L-shaped structure.

The first ground portion 15 is positioned in the receiving space 103. The first ground portion 15 can be a screw, a microstrip line, a probe, or other structures. One end of the first ground portion 15 is electrically connected to an end of the coupling portion A1 adjacent to the second gap 110. Another end of the first ground portion 15 is electrically connected to the first ground point 212 to be grounded.

The second feed portion 16 is positioned in the receiving space 103. The second feed portion 16 can be a screw, a microstrip line, a probe, or other connecting structures. An end of the second feed portion 16 is electrically connected to a side of the radiating portion A2 adjacent to the first gap 109. In this embodiment, the radiating portion A2 is divided into a coupling section A21 and a radiating section A22.

The coupling section A21 is formed by the portion of the side frame 102 from the second feed portion 16 to the first gap 109. The radiating section A22 is formed by the portion of the side frame 102 from the second feed portion 16 to the third gap 111.

In this embodiment, the second feed portion 16 is connected to the radiating portion A2 at a position not at a middle portion of the radiating portion A2. The radiating section A22 is longer than the coupling section A21. Another end of the second feed portion 16 is electrically connected to the second feed point 123 to supply current to the radiating section A22 of the radiating portion A2.

The second ground portion 17 is positioned in the receiving space 103. The second ground portion 17 can be a screw, a microstrip line, a probe, or other structures. One end of the second ground portion 17 is electrically connected to an end of the radiating section A22 adjacent to the third gap 111. Another end of the second ground portion 17 is electrically connected to the second ground point 215 to be grounded.

When the first feed point 211 supplies current, the current flows through the first feed portion 11 and the radiator 13, and is coupled to the coupling portion A1 through the radiator 13. The coupling portion A1 further couples to the coupling section A21 through the first gap 109. Then each of the radiator 13, the coupling portion A1, and the coupling section A21 activate a different operating mode to generate radiation signals in a different radiation frequency band.

For example: the coupling portion A1 can activate a first operating mode to generate radiation signals in a first radiation frequency band; the radiator 13 can activate a second operating mode to generate radiation signals in a second radiation frequency band; and the coupling section A21 can activate a third operating mode to generate radiation signals in a third radiation frequency band.

In this embodiment, the first operating mode and the second operating mode are both Long Term Evolution Advanced (LTE-A) middle frequency operating modes. The third operating mode is a LTE-A high frequency operating mode. Frequencies of the third radiation frequency band are higher than frequencies of the second radiation frequency band. Frequencies of the second radiation frequency band are higher than frequencies of the first radiation frequency band.

In this embodiment, the first radiation frequency band is about 1710-1880 MHz. The second radiation frequency band is about 2000-2300 MHz. The third radiation frequency band is about 2496-2690 MHz. That is, a frequency spread of the first to third radiation frequency bands is about 1710-2690 MHz.

When the second feed source 213 supplies current, the current flows through the second feed portion 16 and the radiating section A22, and is grounded through the second ground portion 17. Then, the second feed point 213, the second feed portion 16, the radiating section A22, and the second ground portion 17 cooperatively form an inverted-F antenna to activate a fourth operating mode to generate radiation signals in a fourth radiation frequency band.

In this embodiment, the fourth operating mode is a LTE-A low frequency operating mode. Frequencies of the first radiation frequency band are higher than frequencies of the fourth radiation frequency band. The fourth radiation frequency band is about 700-960 MHz.

In FIG. 1 and FIG. 3, the antenna structure 100 further includes a switching circuit 18. One end of the switching circuit 18 is electrically connected to the second ground portion 17. Then the switching circuit 18 is electrically connected to the radiating section A22 of the radiating portion A2 through the second ground portion 17. Another end of the switching circuit 18 is electrically connected to the second ground point 215 to be grounded. The switching circuit 18 is used to adjust the fourth radiation frequency band, that is, the low frequency band of the antenna structure 100.

Figure 4:
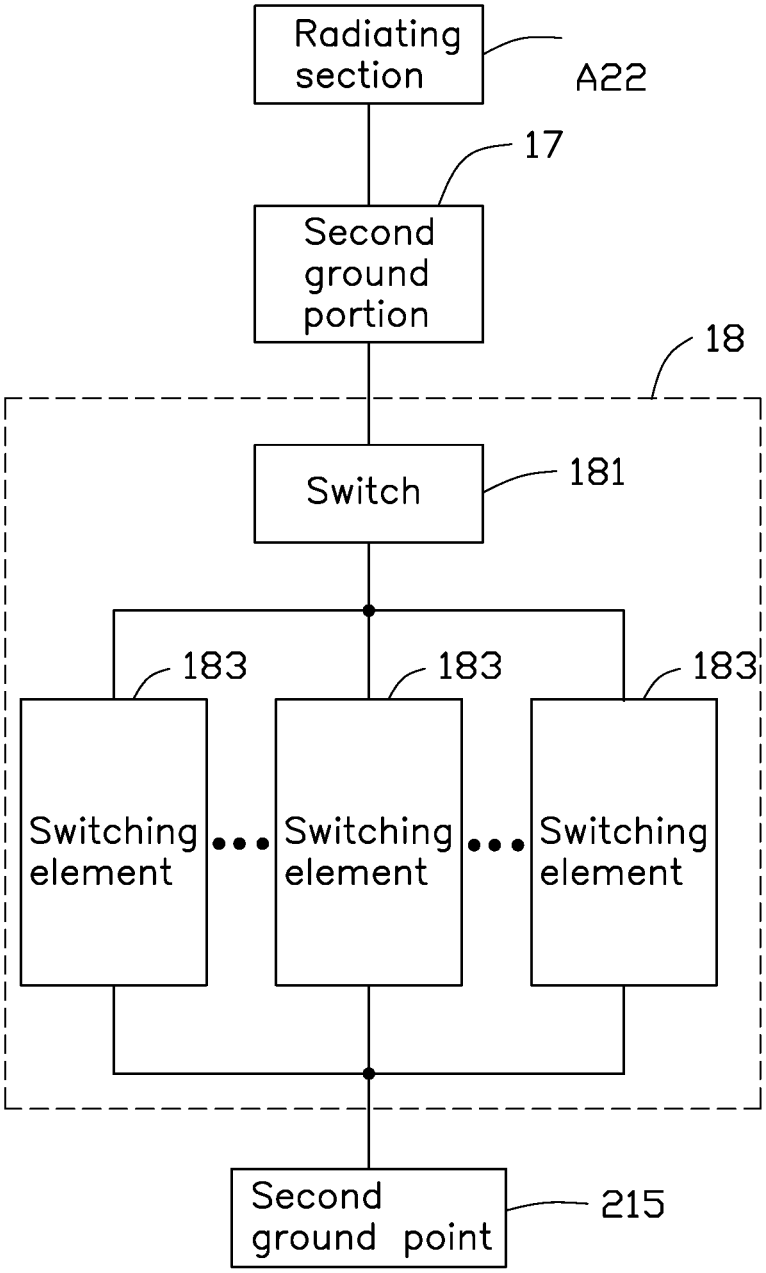
FIG. 4 is a circuit diagram of a switching circuit of the antenna structure of FIG. 1.

As illustrated in FIG. 4, the switching circuit 18 includes a switch 181 and a plurality of switching elements 183. The switch 181 is electrically connected to the second ground portion 17. The switch 181 is also electrically connected to the radiating section A22 of the radiating portion A2 through the second ground portion 17. Each of the switching elements 183 can be an inductor, a capacitor, or a combination of the inductor and the capacitor. The switching elements 183 are connected to each other in parallel. One end of each switching element 183 is electrically connected to the switch 181. The other end of each switching element 183 is electrically connected to the second ground point 215 to be grounded.

Using the switch 181, the radiating section A22 can be switched to connect with different switching elements 183. Since each switching element 183 has a different impedance, the low frequency band of the antenna structure 100, that is, the fourth radiation frequency band, can be adjusted, as described in the next paragraph.

For example, the switching circuit 18 may include four switching elements 183. The four switching elements 183 are all inductors and have respective inductance values of about 2 nH, 10 nH, 15 nH, and 27 nH. When the switch 181 is switched to connect with the switching element 183 having an inductance value of about 2 nH, the antenna structure 100 can work at a frequency band of LTE-A band8 (704-803 MHz). When the switch 181 is switched to connect with the switching element 183 having an inductance value of about 10 nH, the antenna structure 100 can work at a frequency band of LTE-A band5 (824-894 MHz). When the switch 181 is switched to connect with the switching element 183 having an inductance value of about 15 nH, the antenna structure 100 can work at a frequency band of LTE-A band20 (791-862 MHz). When the switch 181 is switched to connect with the switching element 183 having an inductance value of about 27 nH, the antenna structure 100 can work at a frequency band of LTE-A band17 (704-746 MHz). That is, through control of the switch 181, a low frequency band of the antenna structure 100 can cover 700-960 MHz.

As illustrated in FIG. 3, the antenna structure 100 further includes a switching unit 19. One end of the switching unit 19 is electrically connected to the first ground portion 15. Then the switching unit 19 is electrically connected to the coupling portion A1 through the first ground portion 15. Another end of the switching unit 19 is electrically connected to the first ground point 212 to be grounded. The switching unit 19 adjusts the first radiation frequency band and the second radiation frequency band, that is, the middle frequency band of the antenna structure 100. In this embodiment, a circuit structure and a working principle of the switching unit 19 are consistent with the switching circuit 18 shown in FIG. 4.

In FIG. 5A to FIG. 5F, the radiator 13, the coupling portion A1, and the coupling section A21 of the radiating portion A2 are shown having other configurations. However, the three portions (i.e., the radiator 13, the coupling portion A1, and the coupling section A21) must always be spaced apart from each other, the radiator 13 is electrically connected to the first feed point 211, and the coupling portion A1 is electrically connected to the first ground point 212 to be grounded. Additionally, when the radiator 13 supplies current, the current is coupled to one of the coupling portion A1 and the coupling section A21. The one of the coupling portion A1 and the coupling section A21 further couples the current to the other one of the coupling portion A1 and the coupling section A21.

Figure 5A:
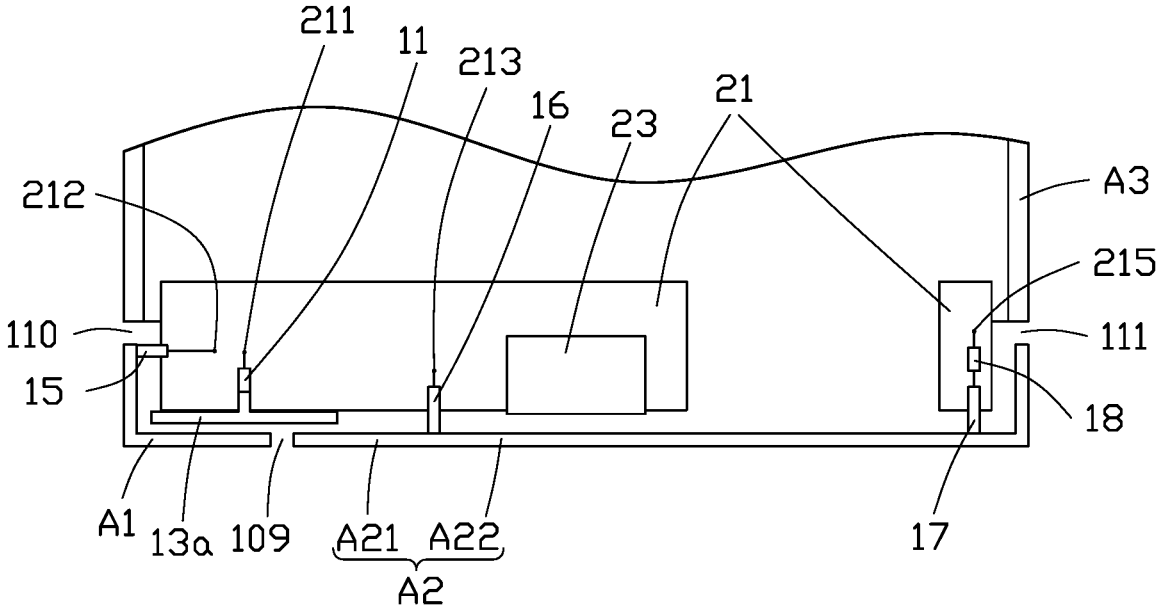
FIG. 5A to FIG. 5F are schematic plan views of the antenna structure of FIG. 3.

In FIG. 5A, the radiator 13*a* is substantially inverted T-shaped. One end of the radiator 13*a* is electrically connected to an end of the first feed portion 11 spaced away from the first feed point 211. Another end of the radiator 13*a* extends along a direction parallel to the first side portion 105 and towards the end portion 104, then splits and bends perpendicularly, then extends along two opposite directions parallel to the end portion 104 and towards the first side portion 105 and the second side portion 106 respectively. The extension continues until the radiator 13*a* passes over the first gap 109. Thus, the radiator 13*a* forms the T-shaped structure. One end of the radiator 13*a* is spaced away from the coupling portion A1. Another end of the radiator 13*a* is spaced away from the coupling section A21.

Figure 5B:
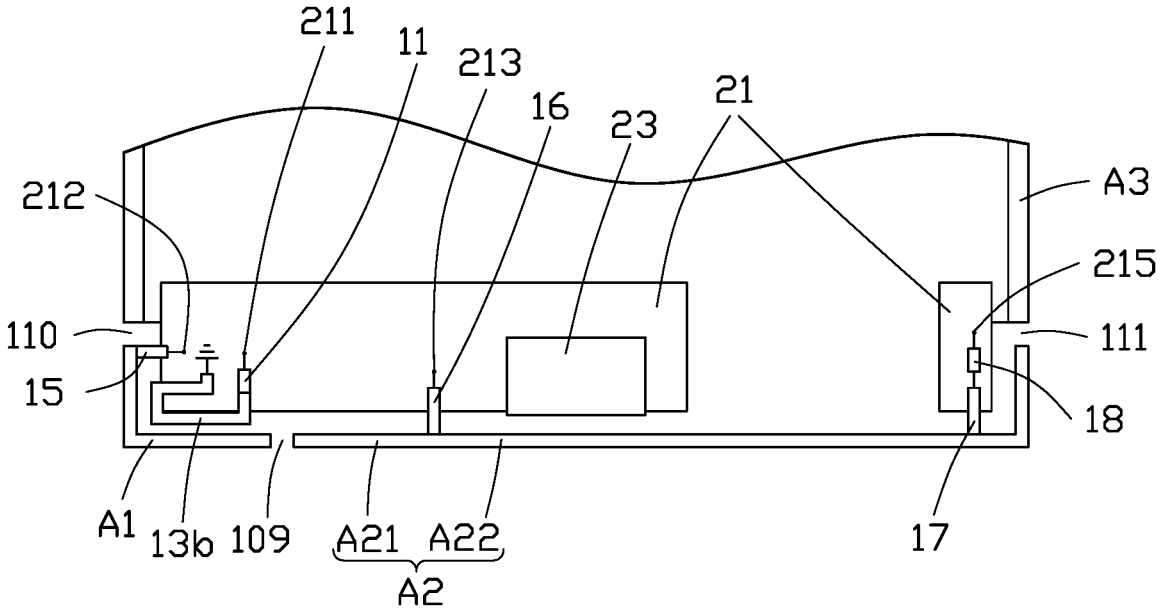

In FIG. 5B, the radiator 13*b* is substantially a loop. One end of the radiator 13*b* is electrically connected to the first feed point 211. Another end of the radiator 13*b* is grounded. Then the radiator 13*b* forms a loop antenna.

Figure 5C:
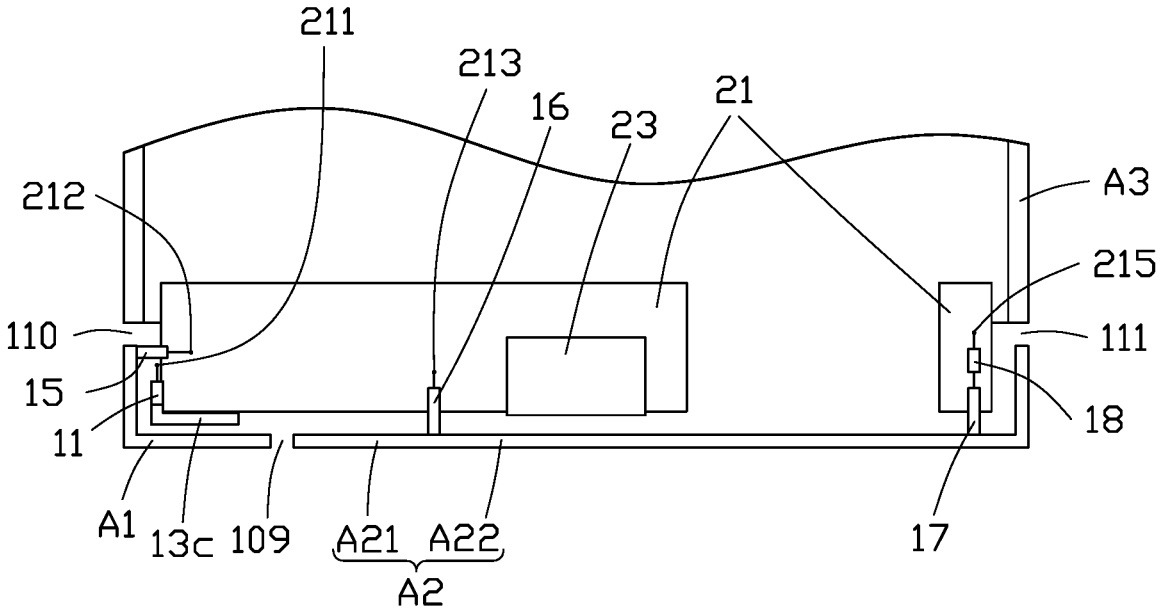

In FIG. 5C, the radiator 13*c* is substantially L-shaped. One end of the radiator 13*c* is electrically connected to an end of the first feed portion 11 spaced away from the first feed point 211. Another end of the radiator 13*c* extends along a direction parallel to the first side portion 105 and towards the end portion 104, then bends perpendicularly, then extends along a direction parallel to the end portion 104 and towards the second side portion 106. Thus, the radiator 13*c* forms the L-shaped structure.

Figure 5D:
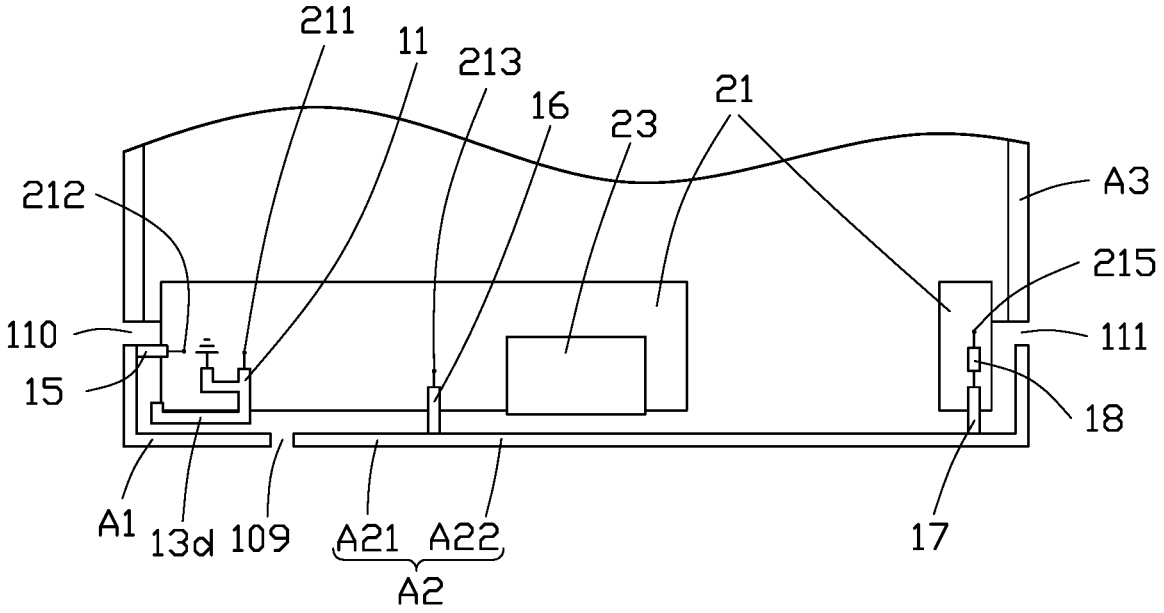

In FIG. 5D, the radiator 13*d* is substantially a loop. One end of the radiator 13*d* is electrically connected to the first feed point 211. Another end of the radiator 13*d* is grounded. Then the radiator 13*d* forms an inverted-F antenna.

Figure 5E:
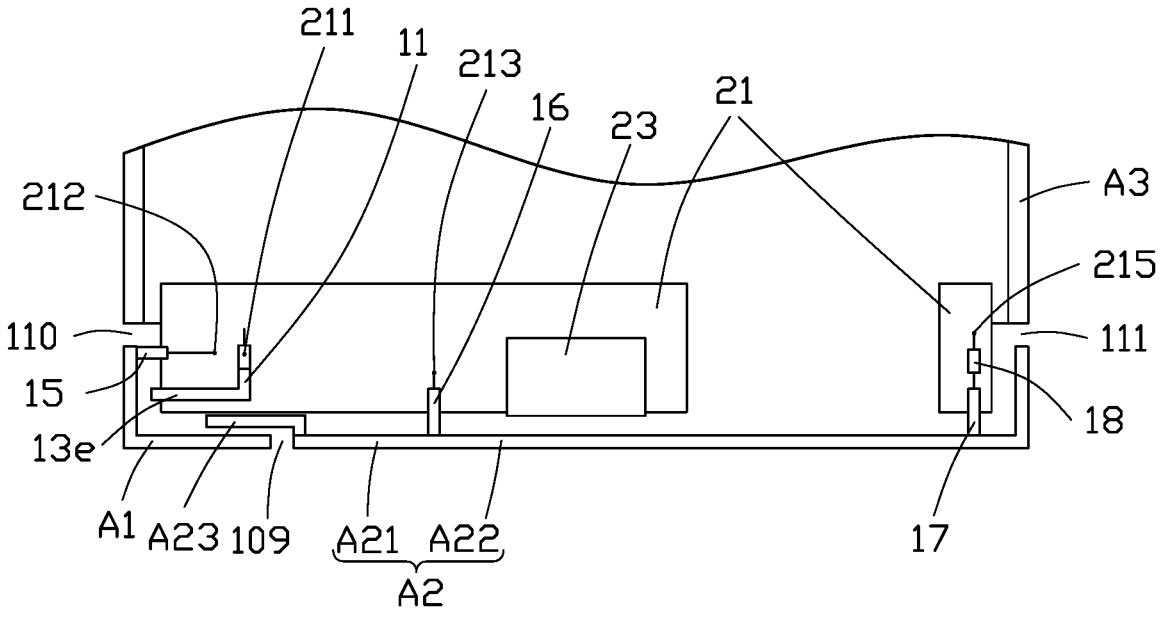

In FIG. 5E, a structure of the radiator 13*e* is the same as the structure of the radiator 13. The antenna structure 100 further includes an extending section A23. The extending section A23 is substantially L-shaped. One end of the extending section A23 is electrically connected to the coupling section A21. Another end of the extending section A23 extends along a direction parallel to the first side portion 105 and spaced away from the end portion 104, then bends perpendicularly, then extends along a direction parallel to the end portion 104 and towards the first side portion 106. The extension continues until the extending section A23 passes over the first gap 109 and is spaced away from the radiator 13*e*.

When the first feed point 211 supplies current, the current flows through the radiator 13*e*, is coupled to the extending section A23 through the radiator 13*e*, and further flows through the coupling section A21. Then the current from the coupling section A21 is further coupled to the coupling portion A1 through the first gap 109.

Figure 5F:
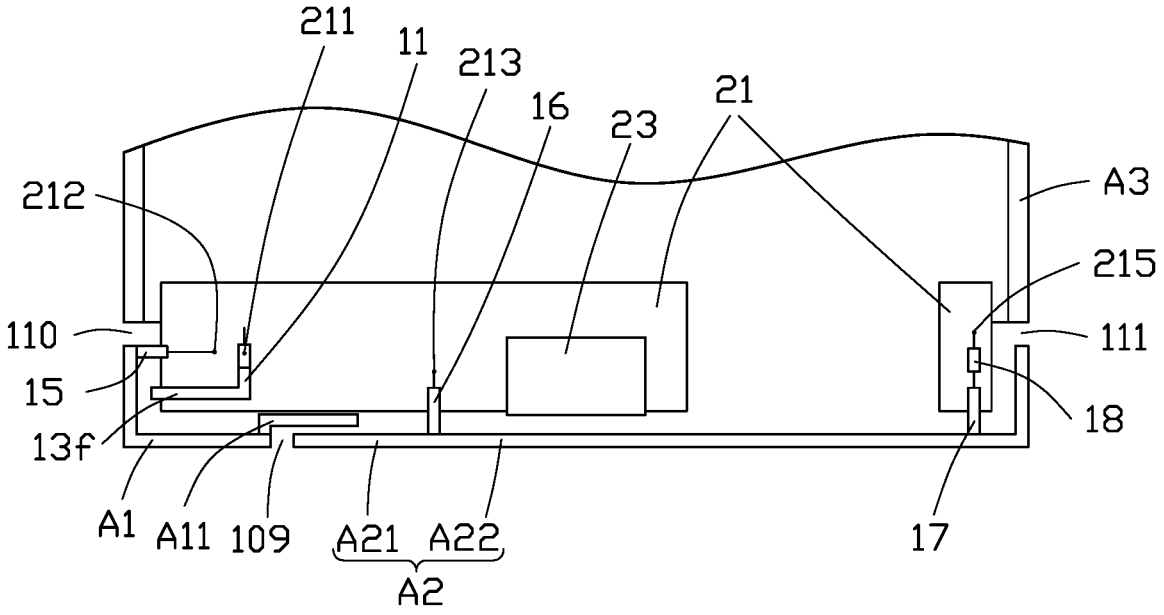

In FIG. 5F, a structure of the radiator 13*f* is the same as the structure of the radiator 13. The antenna structure 100 further includes an extending section A11. The extending section A11 is substantially L-shaped. One end of the extending section A11 is electrically connected to the coupling portion A1. Another end of the extending section A11 extends along a direction parallel to the first side portion 105 and away from the end portion 104, then bends perpendicularly, then extends along a direction parallel to the end portion 104 and towards the second side portion 106. The extension continues until the extending section A11 passes over the first gap 109 and is spaced away from the coupling section A21.

When the first feed point 211 supplies current, the current flows through the radiator 13*f*, is coupled to the coupling portion A1 through the radiator 13*f*, and further flows through the extending section A11. Then the current from the extending section A11 is further coupled to the coupling section A21.

As described above, the antenna structure 100 can activate the first operating mode and the second operating mode to generate radiation signals in the middle frequency band. The antenna structure 100 can further activate the third operating mode to generate radiation signals in the high frequency band and activate the fourth operating mode to generate radiation signals in the low frequency band. Then, the wireless communication device 200 can use carrier aggregation (CA) technology of LTE-A to receive or send wireless signals at multiple frequency bands simultaneously. In detail, the wireless communication device 200 can use the CA technology of LTE-A and use the radiator 13, the coupling portion A1, and the radiating portion A2 to receive or send wireless signals at multiple frequency bands simultaneously, that is, can realize 2CA or 3CA.

Figure 6:
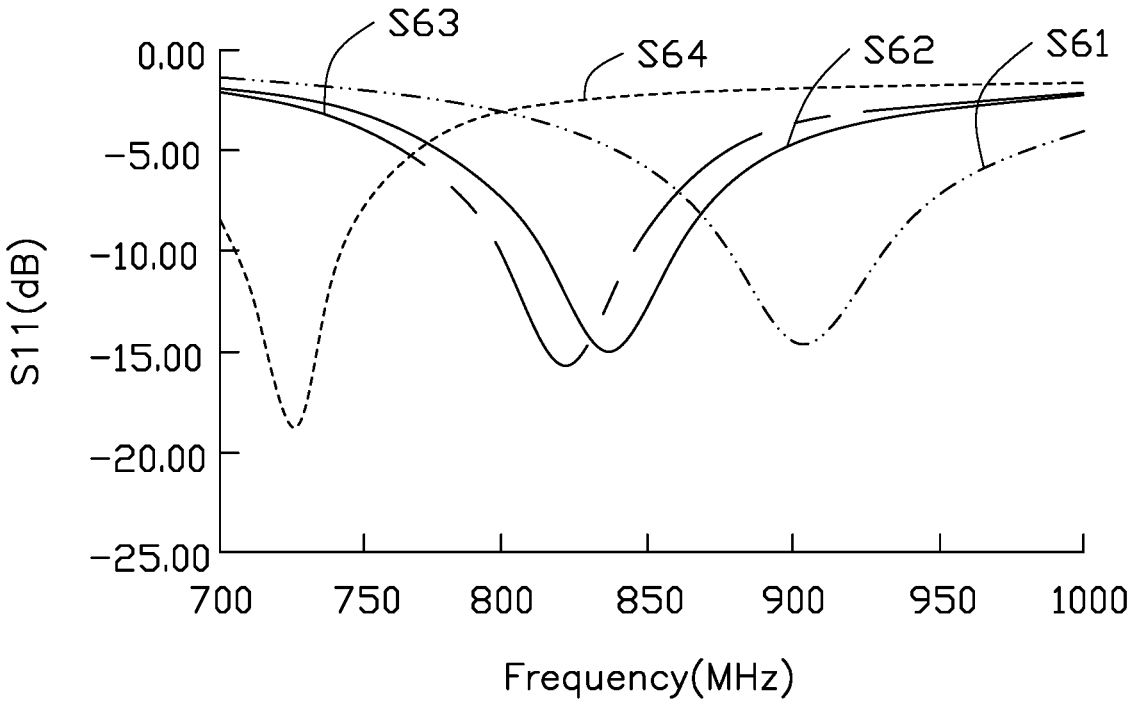
FIG. 6 is a scattering parameter graph when the antenna structure of FIG. 1 works at a Long Term Evolution Advanced (LTE-A) low frequency operating mode.

FIG. 6 is a scattering parameter graph of the antenna structure 100, when the antenna structure 100 works at the low frequency operating mode. Curve S61 is a scattering parameter of the antenna structure 100 when the switch 181 is switched to connect with a switching element 183 having an inductance value of about 2 nH. Curve S62 is a scattering parameter of the antenna structure 100 when the switch 181 is switched to connect with a switching element 183 having an inductance value of about 10 nH. Curve S63 is a scattering parameter of the antenna structure 100 when the switch 181 is switched to connect with a switching element 183 having an inductance value of about 15 nH. Curve S64 is a scattering parameter of the antenna structure 100 when the switch 181 is switched to connect with a switching element 183 having an inductance value of about 27 nH.

Figure 7:
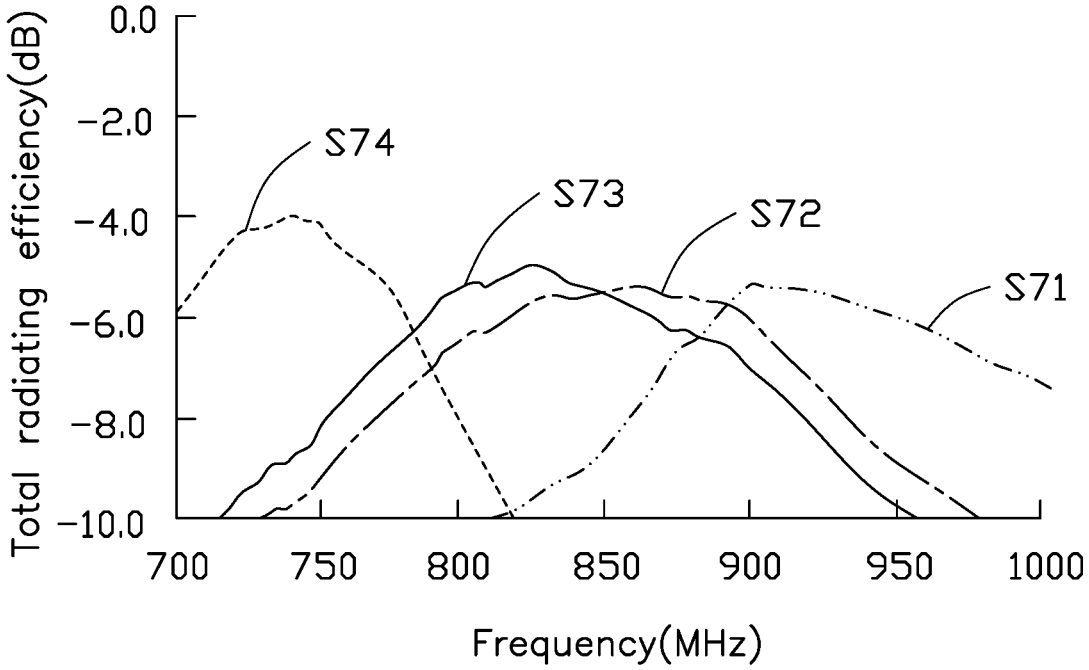
FIG. 7 is a total radiating efficiency graph when the antenna structure of FIG. 1 works at the LTE-A low frequency operating mode.

FIG. 7 is a total radiating efficiency graph of the antenna structure 100, when the antenna structure 100 works at the low frequency operating mode. Curve S71 is a total radiating efficiency of the antenna structure 100 when the switch 181 is switched to connect with a switching element 183 having an inductance value of about 2 nH. Curve S72 is a total radiating efficiency of the antenna structure 100 when the switch 181 is switched to connect with a switching element 183 having an inductance value of about 10 nH. Curve S73 is a total radiating efficiency of the antenna structure 100 when the switch 181 is switched to connect with a switching element 183 having an inductance value of about 15 nH. Curve S74 is a total radiating efficiency of the antenna structure 100 when the switch 181 is switched to connect with a switching element 183 having an inductance value of about 27 nH.

FIGS. 6-7 show a frequency of the antenna structure 100 at the low frequency operating mode can be effectively adjusted by the switch 181. When different frequency bands of the low frequency band are switched in, the middle frequency band and the high frequency band of the antenna structure 100 may not be affected.

Figure 8:
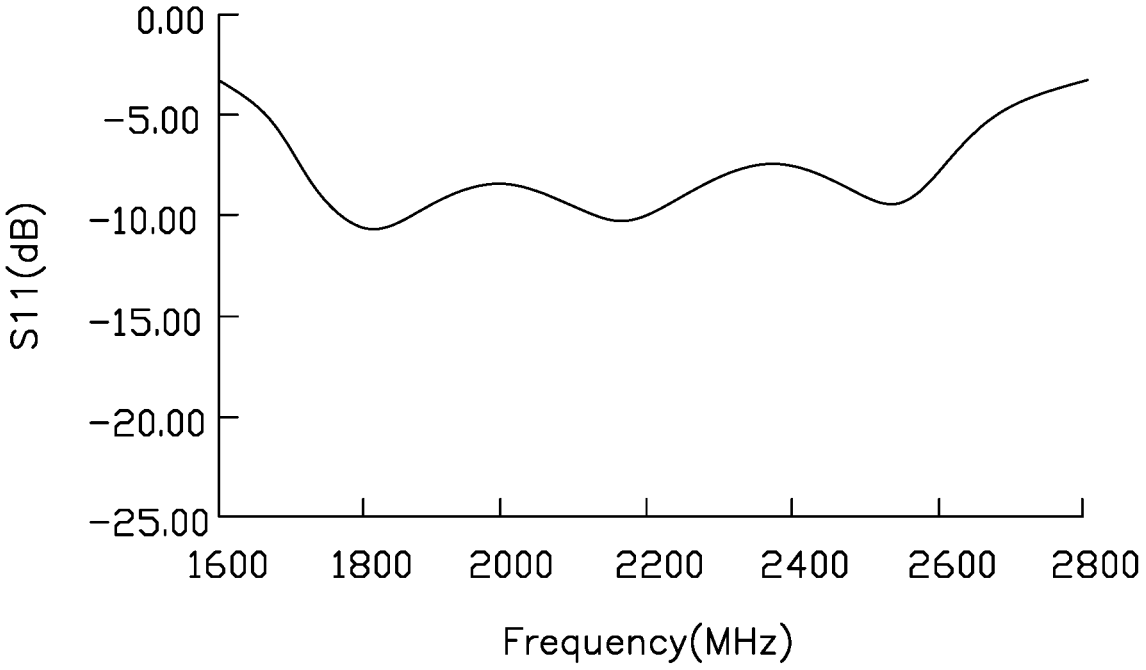
FIG. 8 is a scattering parameter graph when the antenna structure of FIG. 1 works at LTE-A middle and high frequency operating modes.
Figure 9:
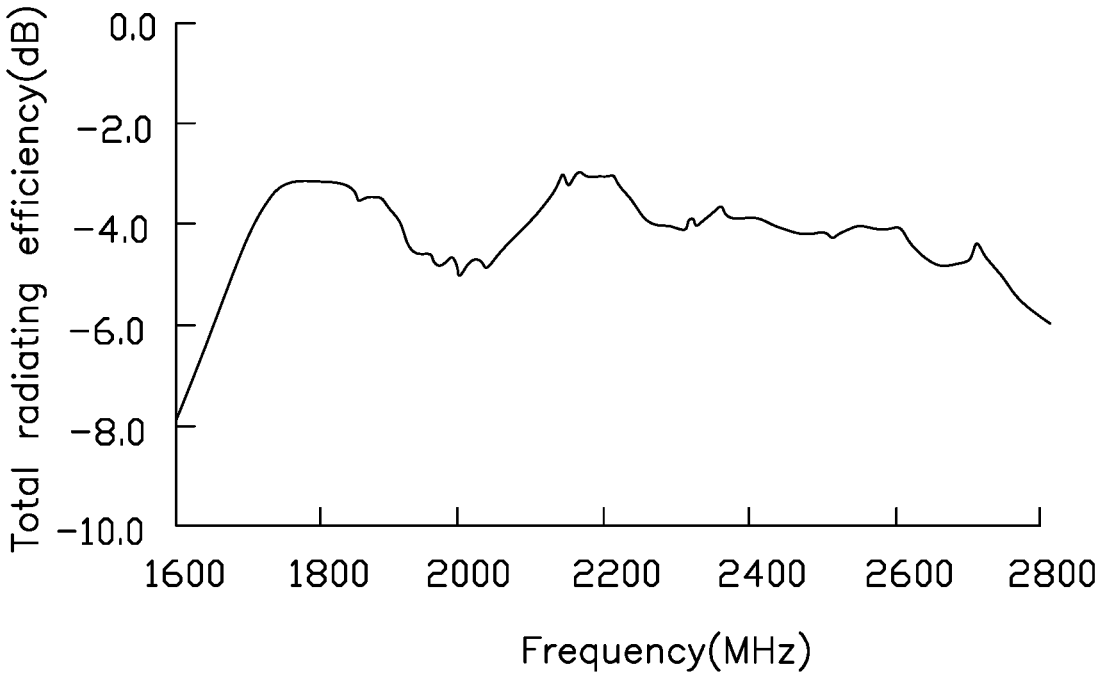
FIG. 9 is a total radiating efficiency graph when the antenna structure of FIG. 1 works at the LTE-A middle and high frequency operating modes.

FIG. 8 is a scattering parameter graph of the antenna structure 100, when the antenna structure 100 works at the middle and high frequency operating modes. FIG. 9 is a total radiating efficiency graph of the antenna structure 100, when the antenna structure 100 works at the middle and high frequency operating modes.

In FIG. 6 to FIG. 9, the antenna structure 100 may completely cover system bandwidths required by current communication systems. For example, the low frequency band of the antenna structure 100 can cover 700-960 MHz, and the antenna efficiency is greater than −6 dB. The middle and high frequency bands of the antenna structure 100 can cover 1710-2690 MHz, and the antenna efficiency is greater than −5 dB, which meets the antenna design requirements.

The antenna structure 100 includes the housing 10. The radiator 13, the coupling portion A1, and the coupling section A21 are spaced apart from each other. Then the frequencies of the low, middle, and high frequency bands of the antenna structure 100 can be controlled through secondary coupling. The frequencies of the low, middle, and high frequency bands of the antenna structure 100 can also meet the requirements of Carrier Aggregation (CA) of Long Term Evolution Advanced (LTE-Advanced).

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing made of metallic material and comprising a coupling portion and a coupling section, the coupling portion spaced apart from the coupling section;

a radiator, the radiator positioned in the housing, the radiator spaced apart from the coupling portion and the coupling section;

a first feed portion, the first feed portion positioned in the housing, one end of the first feed portion electrically connected to a first feed point, another end of the first feed portion electrically connected to the radiator;

a first ground portion, the first ground portion positioned in the housing, one end of the first ground portion electrically connected to the coupling portion, another end of the first ground portion being grounded;

wherein when the first feed point supplies current, the current flows through the first feed portion and the radiator, and is coupled to one of the coupling portion and the coupling section through the radiator; wherein the current is further coupled to the other one of the coupling portion and the coupling section through the one of the coupling portion and the coupling section, and the radiator, the coupling portion, and the coupling section activate three different operating modes, each operating mode generating radiation signals in one of three different radiation frequency bands;

wherein the housing comprises a side frame, the side frame defines a first gap, a second gap, and a third gap, the first gap, the second gap, and the third gap all extend to cut across the side frame, the coupling portion is formed by a first portion of the side frame between the first gap and the second gap, a radiating portion is formed by a second portion of the side frame between the first gap and the third gap, and the coupling section is formed by a portion of the radiating portion.

2. The antenna structure of claim 1, wherein the coupling portion activates a first operating mode to generate radiation signals in a first radiation frequency band, the radiator activates a second operating mode to generate radiation signals in a second radiation frequency band, the coupling section activates a third operating mode to generate radiation signals in a third radiation frequency band;

wherein:

frequencies of the third radiation frequency band are higher than frequencies of the second radiation frequency band, and frequencies of the second radiation frequency band are higher than frequencies of the first radiation frequency band.

3. The antenna structure of claim 2, wherein the housing further comprises a backboard, the side frame is positioned around a periphery of the backboard, the backboard defines a slot, the first gap, the second gap, and the third gap are all in communication with the slot wherein a grounding portion is formed by portions of the side frame not associated with the coupling portion and the radiating portion, the grounding portion is grounded.

4. The antenna structure of claim 3, further comprising a second feed portion, wherein one end of the second feed portion is electrically connected to the radiating portion, the coupling section is formed by the portion of the side frame from the second feed portion to the first gap.

5. The antenna structure of claim 4, further comprising a second ground portion, wherein a radiating section is formed by the portion of the side frame from the second feed portion to the third gap;

wherein another end of the second feed portion is electrically connected to a second feed point, one end of the second ground portion is electrically connected to the radiating section, another end of the second ground portion is grounded;

wherein when the second feed source supplies current, the current flows through the radiating section and is grounded through the second ground portion to activate a fourth operating mode to generate radiation signals in a fourth radiation frequency band; and wherein frequencies of the first radiation frequency band are higher than frequencies of the fourth radiation frequency band.

6. The antenna structure of claim 5, further comprising a switching circuit, wherein the switching circuit comprises a switch and a plurality of switching elements, the switch is electrically connected to the radiating section through the second ground portion, the switching elements are connected to each other in parallel, one end of each switching element is electrically connected to the switch and the other end of each switching element is grounded;

wherein the switch can be made to connect with different switching elements for adjusting the fourth radiation frequency band.

7. The antenna structure of claim 2, further comprising a switching unit, wherein one end of the switching unit is electrically connected to the coupling portion through the first ground portion, another end of the switching unit is grounded for adjusting the first and second radiation frequency bands.

8. The antenna structure of claim 3, wherein a wireless communication device uses the radiator, the coupling portion, and the radiating portion to receive or send wireless signals at multiple frequency bands simultaneously through carrier aggregation (CA) technology of Long Term Evolution Advanced (LTE-A).

9. The antenna structure of claim 3, wherein the side frame comprises an end portion, a first side portion, and a second side portion, the first side portion and the second side portion are respectively connected to two ends of the end portion; the first gap is defined at the end portion, the second gap is defined at the first side portion, the third gap is defined at the second side portion; wherein the radiator is positioned at a receiving space beginning at the coupling portion and ending at the first gap and the second gap.

10. The antenna structure of claim 9, wherein one end of the radiator is electrically connected to an end of the first feed portion spaced away from the first feed point, another end of the radiator extends along a direction parallel to the first side portion and towards the end portion, then splits and bends perpendicularly, then extends along two opposite directions parallel to the end portion and towards the first side portion and the second side portion respectively until the radiator passes over the first gap, thereby causing the radiator to have a substantially inverted T-shaped structure.

11. The antenna structure of claim 9, wherein one end of the radiator is electrically connected to the first feed point and another end of the radiator is grounded, thereby causing the radiator to form a loop antenna; or one end of the radiator is electrically connected to the first feed point, another end of the radiator is grounded, thereby causing the radiator to form an inverted-F antenna.

12. The antenna structure of claim 9, wherein one end of the radiator is perpendicularly connected to an end of the first feed portion spaced away from the first feed point, another end of the radiator extends along a direction parallel to the first side portion and towards the end portion, then bends perpendicularly, then extends along a direction parallel to the end portion and towards the first side portion or the second side portion, thereby causing the radiator to have a substantially L-shaped structure.

13. The antenna structure of claim 12, further comprising an extending section, wherein the extending section is substantially L-shaped, one end of the extending section is electrically connected to the coupling section, another end of the extending section extends along a direction parallel to the first side portion and away from the end portion, then bends perpendicularly, then extends along a direction parallel to the end portion and towards the first side portion until the extending section passes over the first gap and is spaced apart from the radiator.

14. The antenna structure of claim 12, further comprising an extending section, wherein the extending section is substantially L-shaped, one end of the extending section is electrically connected to the coupling portion, another end of the extending section extends along a direction parallel to the first side portion and away from the end portion, then bends perpendicularly, then extends along a direction parallel to the end portion and towards the second side portion until the extending section passes over the first gap and is spaced apart from the coupling section.

15. A wireless communication device comprising:

an antenna structure, the antenna structure comprising:

a housing, the housing made of metallic material and comprising a coupling portion and a coupling section, the coupling portion spaced apart from the coupling section;

a radiator, the radiator positioned in the housing, the radiator spaced apart from the coupling portion and the coupling section;

a first feed portion, the first feed portion positioned in the housing, one end of the first feed portion electrically connected to a first feed point, another end of the first feed portion electrically connected to the radiator;

a first ground portion, the first ground portion positioned in the housing, one end of the first ground portion electrically connected to the coupling portion, another end of the first ground portion being grounded;

wherein when the first feed point supplies current, the current flows through the first feed portion and the radiator, and is coupled to one of the coupling portion and the coupling section through the radiator; wherein the current is further coupled to the other one of the coupling portion and the coupling section through the one of the coupling portion and the coupling section, and the radiator, the coupling portion, and the coupling section activate three different operating modes, each operating mode generating radiation signals in one of three different radiation frequency bands;

wherein the housing comprises a side frame, the side frame defines a first gap, a second gap, and a third gap, the first gap, the second gap, and the third gap all extend to cut across the side frame, the coupling portion is formed by a first portion of the side frame between the first gap and the second gap, a radiating portion is formed by a second portion of the side frame between the first gap and the third gap, and the coupling section is formed by a portion of the radiating portion.

16. The wireless communication device of claim 15, wherein the coupling portion activates a first operating mode to generate radiation signals in a first radiation frequency band, the radiator activates a second operating mode to generate radiation signals in a second radiation frequency band, the coupling section activates a third operating mode to generate radiation signals in a third radiation frequency band;

wherein:

frequencies of the third radiation frequency band are higher than frequencies of the second radiation frequency band, and frequencies of the second radiation frequency band are higher than frequencies of the first radiation frequency band.

17. The wireless communication device of claim 16, wherein the housing further comprises a backboard, the side frame is positioned around a periphery of the backboard, the backboard defines a slot, the first gap, the second gap, and the third gap are all in communication with the slot wherein a grounding portion is formed by portions of the side frame not associated with the coupling portion and the radiating portion, the grounding portion is grounded.

18. The wireless communication device of claim 17, wherein the antenna structure further comprises a second feed portion, one end of the second feed portion is electrically connected to the radiating portion, the coupling section is formed by the portion of the side frame from the second feed portion to the first gap.

19. The wireless communication device of claim 18, wherein the antenna structure further comprises a second ground portion, a radiating section is formed by the portion of the side frame from the second feed portion to the third gap;

wherein another end of the second feed portion is electrically connected to a second feed point, one end of the second ground portion is electrically connected to the radiating section, another end of the second ground portion is grounded;

wherein when the second feed source supplies current, the current flows through the radiating section and is grounded through the second ground portion to activate a fourth operating mode to generate radiation signals in a fourth radiation frequency band; and wherein frequencies of the first radiation frequency band are higher than frequencies of the fourth radiation frequency band.

20. The wireless communication device of claim 19, wherein the antenna structure further comprises a switching circuit, the switching circuit comprises a switch and a plurality of switching elements, the switch is electrically connected to the radiating section through the second ground portion, the switching elements are connected to each other in parallel, one end of each switching element is electrically connected to the switch and the other end of each switching element is grounded; wherein the switch can be made to connect with different switching elements for adjusting the fourth radiation frequency band.

21. The wireless communication device of claim 16, wherein the antenna structure further comprises a switching unit, one end of the switching unit is electrically connected to the coupling portion through the first ground portion, another end of the switching unit is grounded for adjusting the first and second radiation frequency bands.

22. The wireless communication device of claim 17, wherein the side frame comprises an end portion, a first side portion, and a second side portion, the first side portion and the second side portion are respectively connected to two ends of the end portion; the first gap is defined at the end portion, the second gap is defined at the first side portion, the third gap is defined at the second side portion; wherein the radiator is positioned at a receiving space beginning at the coupling portion and ending at the first gap and the second gap.

23. The wireless communication device of claim 22, wherein one end of the radiator is perpendicularly connected to an end of the first feed portion spaced away from the first feed point, another end of the radiator extends along a direction parallel to the first side portion and towards the end portion, then bends perpendicularly, then extends along a direction parallel to the end portion and towards the first side portion or the second side portion, thereby causing the radiator to have a substantially L-shaped structure.

24. The wireless communication device of claim 23, wherein the antenna structure further comprises an extending section, the extending section is substantially L-shaped, one end of the extending section is electrically connected to the coupling section, another end of the extending section extends along a direction parallel to the first side portion and away from the end portion, then bends perpendicularly, then extends along a direction parallel to the end portion and towards the first side portion until the extending section passes over the first gap and is spaced apart from the radiator.

25. The wireless communication device of claim 23, wherein the antenna structure further comprises an extending section, the extending section is substantially L-shaped, one end of the extending section is electrically connected to the coupling portion, another end of the extending section extends along a direction parallel to the first side portion and away from the end portion, then bends perpendicularly, then extends along a direction parallel to the end portion and towards the second side portion until the extending section passes over the first gap and is spaced apart from the coupling section.

26. The wireless communication device of claim 22, wherein one end of the radiator is electrically connected to an end of the first feed portion spaced away from the first feed point, another end of the radiator extends along a direction parallel to the first side portion and towards the end portion, then splits and bends perpendicularly, then extends along two opposite directions parallel to the end portion and towards the first side portion and the second side portion respectively until the radiator passes over the first gap, thereby causing the radiator to have a substantially inverted T-shaped structure.

27. The wireless communication device of claim 22, wherein one end of the radiator is electrically connected to the first feed point and another end of the radiator is grounded, thereby causing the radiator to form a loop antenna; or one end of the radiator is electrically connected to the first feed point, another end of the radiator is grounded, thereby causing the radiator to form an inverted-F antenna.

* * * * *